US010105726B2

(12) United States Patent
Snyder et al.

(10) Patent No.: US 10,105,726 B2
(45) Date of Patent: Oct. 23, 2018

(54) FLUID FLOW SINKER

(71) Applicant: Saint-Gobain Performance Plastics Corporation, Solon, OH (US)

(72) Inventors: Mitchell L. Snyder, Hope, MI (US); Thomas R. Nixon, Au Gres, MI (US)

(73) Assignee: SAINT-GOBAIN PERFORMANCE PLASTICS CORPORATION, Solon, OH (US)

( * ) Notice: Subject to any disclaimer, the term of this patent is extended or adjusted under 35 U.S.C. 154(b) by 17 days.

(21) Appl. No.: 14/695,512

(22) Filed: Apr. 24, 2015

(65) Prior Publication Data

US 2015/0306619 A1 Oct. 29, 2015

Related U.S. Application Data

(60) Provisional application No. 61/984,150, filed on Apr. 25, 2014.

(51) Int. Cl.

| | |
|---|---|
| ***B05B 15/00*** | (2018.01) |
| ***B05B 11/00*** | (2006.01) |
| ***B05B 15/33*** | (2018.01) |

(52) U.S. Cl.

CPC ..... *B05B 15/006* (2013.01); *B05B 11/0037* (2013.01); *B05B 15/33* (2018.02)

(58) Field of Classification Search

CPC .... B05B 15/006; B05B 11/0037; B05B 15/33
See application file for complete search history.

(56) References Cited

U.S. PATENT DOCUMENTS

| | | | | |
|---|---|---|---|---|
| 1,581,508 | A | 4/1926 | Bomhard | |
| 2,344,005 | A * | 3/1944 | Sundholm | F04B 9/14 222/382 |
| RE26,470 | E | 10/1968 | Deuschle et al. | |
| 3,541,583 | A | 11/1970 | Deuschle | |
| 4,245,760 | A * | 1/1981 | Stevenson | A01M 7/0089 137/240 |
| 4,273,272 | A * | 6/1981 | Blanc | B05B 11/0059 222/464.4 |
| 4,537,334 | A | 8/1985 | Spengler et al. | |

(Continued)

FOREIGN PATENT DOCUMENTS

| | | |
|---|---|---|
| EP | 1477194 A2 | 11/2004 |
| EP | 1253863 B1 | 9/2007 |

(Continued)

OTHER PUBLICATIONS

International Search Report from PCT/US2015/027499 dated Aug. 7, 2015, 1 pg.

(Continued)

*Primary Examiner* — Frederick C Nicolas
(74) *Attorney, Agent, or Firm* — Abel Law Group, LLP; Chi Suk Kim

(57) ABSTRACT

A fluid flow sinker including a body having a generally cylindrical sidewall, a first end, a second end, and an aperture extending between the first and second ends; and a fluid passageway disposed on the first end and extending from the generally cylindrical sidewall to the aperture, wherein the fluid flow sinker is adapted to receive a tube in communication with the aperture.

20 Claims, 12 Drawing Sheets

(56) References Cited

U.S. PATENT DOCUMENTS

| | | | | |
|---|---|---|---|---|
| 4,630,759 | A * | 12/1986 | Dawn | B67D 7/58 222/372 |
| 5,114,342 | A | 5/1992 | Young et al. | |
| 5,195,664 | A * | 3/1993 | Rhea | B05B 11/0059 222/382 |
| 5,215,227 | A * | 6/1993 | Farner | F41H 9/10 222/175 |
| 5,217,044 | A | 6/1993 | Schulte | |
| D379,854 | S | 6/1997 | Hirsch et al. | |
| 5,690,487 | A | 11/1997 | Whitehouse et al. | |
| 5,743,736 | A | 4/1998 | Folko et al. | |
| 5,769,284 | A * | 6/1998 | Vargas | B67D 7/061 222/464.4 |
| 5,839,620 | A * | 11/1998 | Battegazzore | B05B 11/0059 222/382 |
| 5,931,670 | A | 8/1999 | Davis | |
| 6,027,041 | A * | 2/2000 | Evans | B05B 11/0059 222/382 |
| 6,156,004 | A | 12/2000 | Tremaine et al. | |
| 6,183,254 | B1 | 2/2001 | Cohen | |
| 6,193,101 | B1 | 2/2001 | Murphy et al. | |
| 6,227,412 | B1 * | 5/2001 | Sweeton | B05B 15/00 222/189.1 |
| 6,290,265 | B1 | 9/2001 | Warburton-Pitt et al. | |
| 6,375,092 | B1 | 4/2002 | Banach | |
| 6,602,072 | B2 | 8/2003 | Burney | |
| 6,695,179 | B2 * | 2/2004 | Mandile | B67D 1/08 222/211 |
| 6,779,693 | B2 * | 8/2004 | Sweeton | B05B 15/006 222/382 |
| 6,821,118 | B2 | 11/2004 | Schlussel | |
| 6,969,046 | B2 | 11/2005 | Streutker et al. | |
| 7,240,810 | B2 | 7/2007 | Harrity et al. | |
| 7,335,023 | B2 | 2/2008 | Mahlmann | |
| 7,377,780 | B2 | 5/2008 | White et al. | |
| 7,500,584 | B2 * | 3/2009 | Schutz | A61C 17/02 15/22.1 |
| 7,648,083 | B2 | 1/2010 | Hornsby et al. | |
| 7,942,873 | B2 | 5/2011 | Kwan et al. | |
| 8,191,740 | B2 | 6/2012 | Hoss et al. | |
| D692,143 | S | 10/2013 | Shahidi Bonjar | |
| 8,545,401 | B2 | 10/2013 | Hajarian et al. | |
| 8,603,049 | B2 | 12/2013 | Morris et al. | |
| 8,870,568 | B1 | 10/2014 | Ream | |
| 9,138,109 | B1 | 9/2015 | Leon | |
| D741,495 | S | 10/2015 | Snyder et al. | |
| D749,749 | S | 2/2016 | Snyder et al. | |
| 9,248,463 | B2 | 2/2016 | Anzalone et al. | |
| 2003/0134254 | A1 | 7/2003 | Filho | |
| 2003/0218030 | A1 | 11/2003 | Torres et al. | |
| 2006/0088800 | A1 | 4/2006 | Neff et al. | |
| 2006/0259014 | A1 | 11/2006 | Yarger | |
| 2008/0145815 | A1 | 6/2008 | Hershey et al. | |
| 2012/0001112 | A1 | 1/2012 | Alkemade et al. | |
| 2014/0072744 | A1 | 3/2014 | Sitcoske | |
| 2015/0306619 | A1 | 10/2015 | Snyder et al. | |

FOREIGN PATENT DOCUMENTS

| | | | |
|---|---|---|---|
| JP | H08299863 | A | 11/1996 |
| JP | H11180481 | A | 7/1999 |
| JP | 2002019862 | A | 1/2002 |
| JP | 2005145457 | A | 6/2005 |
| JP | 2009066501 | A | 4/2009 |
| WO | 2013063457 | A1 | 5/2013 |
| WO | 2015164729 | A1 | 10/2015 |

OTHER PUBLICATIONS

Supplementary European Search Report for EP15782262 dated Dec. 22, 2017, 9 pages.

* cited by examiner

FLUID FLOW SINKER

CROSS-REFERENCE TO RELATED APPLICATION(S)

This application claims priority under 35 U.S.C. § 119(e) to U.S. Patent Application No. 61/984,150 entitled "FLUID FLOW SINKER," by Mitchell L. Snyder, et al., filed Apr. 25, 2014, which is assigned to the current assignee hereof and incorporated herein by reference in its entirety.

FIELD OF THE DISCLOSURE

The present disclosure relates to fluid flow devices, and more particular to a fluid flow sinker.

RELATED ART

Fluid is typically extracted from a vessel by a tube. The tube can have a soft construction, allowing it to move within the vessel. Conversely, the tube can have a hard construction, such that it is adapted to remain rigid during fluid removal. A negative pressure can be applied within an internal bore of the tube, causing a fluid to flow through the tube at a desired flow rate. In the case of soft tubes, such as, for example, those typically used in the manufacturing of pharmaceuticals, application of a negative pressure within the tube can cause the tube to stick against a sidewall of the vessel. Once stuck, the negative pressure formed within the tube can generate a vacuum, preventing the tube from decoupling from the sidewall of the vessel and resulting in the termination, or halt, of fluid flow.

Any termination of fluid flow can increase the time required to evacuate the vessel and, especially in the case of pharmaceuticals where the fluid can be delicate and expensive, raise operating costs. In timed applications, where suction is applied to the tube for a predefined period of time, even a temporary termination or reduction in fluid flow can result in a larger portion of the fluid remaining in the vessel. Particularly in the pharmaceutical industry, even the smallest loss in fluid can render an operation unsustainable.

There continues to exist a need for a device that can permit unrestricted, or nearly unrestricted, fluid flow while simultaneously preventing a tube from forming a vacuum against a sidewall or a bottom surface of a vessel.

BRIEF DESCRIPTION OF THE DRAWINGS

Embodiments are illustrated by way of example and are not limited in the accompanying figures.

DETAILED DESCRIPTION

Figure 1:
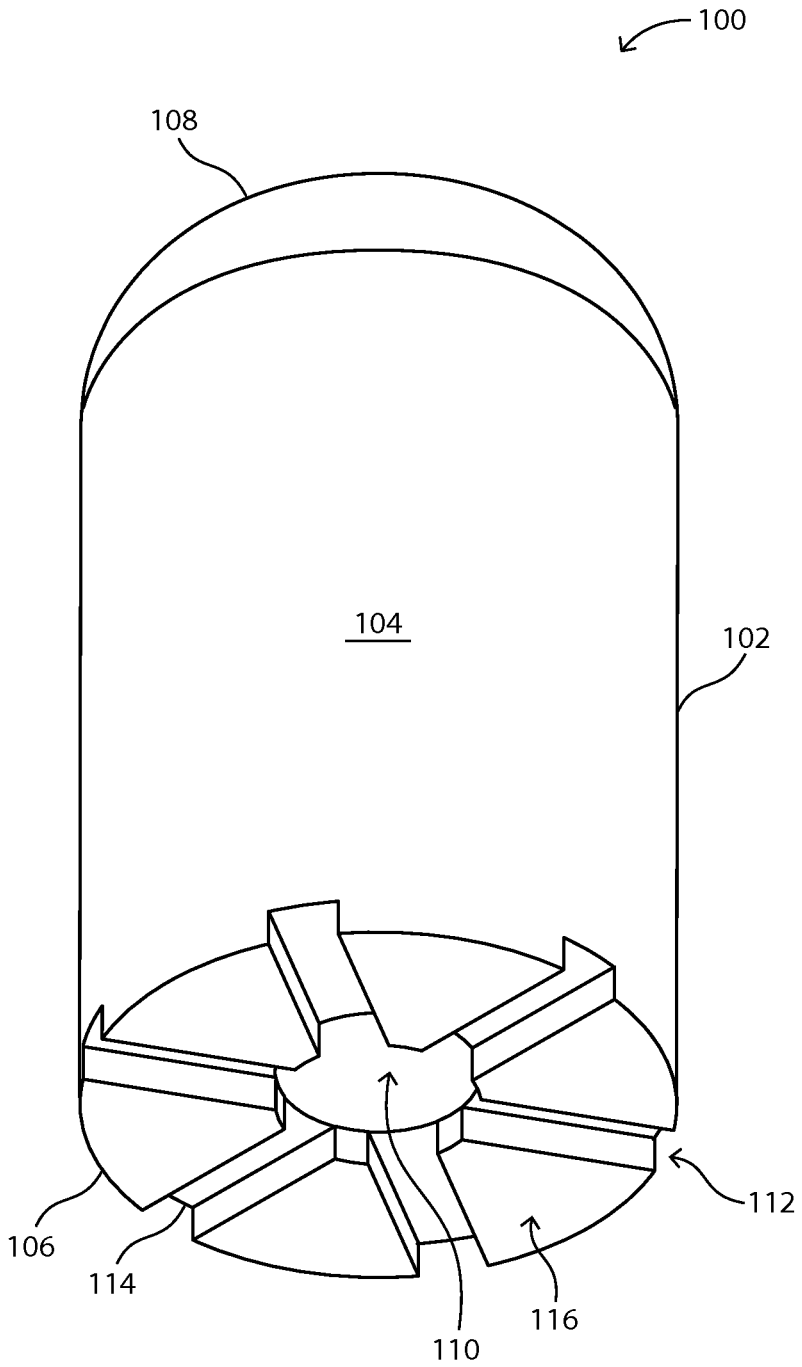
FIG. 1 includes a perspective view of a fluid flow sinker in accordance with an embodiment.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the fluid transportation arts.

A fluid flow sinker in accordance with one or more of the embodiments described herein can generally include a body having a generally cylindrical sidewall, a first end, a second end, and an aperture extending between the first and second ends. The second end of the body can be adapted to receive a tube in a manner such that the tube is in fluid communication with the aperture. The fluid flow sinker can further include a fluid passageway disposed on the first end of the body and extending from the generally cylindrical sidewall to the aperture. In this regard, a fluid can be drawn into the aperture at all times, including when the first end of the body is flush against, or parallel with, a surface of a vessel.

A fluid flow sinker assembly in accordance with one or more of the embodiments described herein can generally include a fluid flow sinker as described above and a tube in fluid communication with the aperture of the fluid flow sinker. The tube can extend from the second end of the fluid flow sinker to a second position, external to a vessel into which the fluid flow sinker can be positioned, where the tube can be coupled with a fluid urging device, such as, for example, a pump. In such a manner, the fluid flow sinker can cause the tube to remain submerged within a vessel while simultaneously preventing the tube from forming an air lock, e.g., a vacuum, with a wall of the vessel, thus enhancing fluid flow properties.

Figure 2:
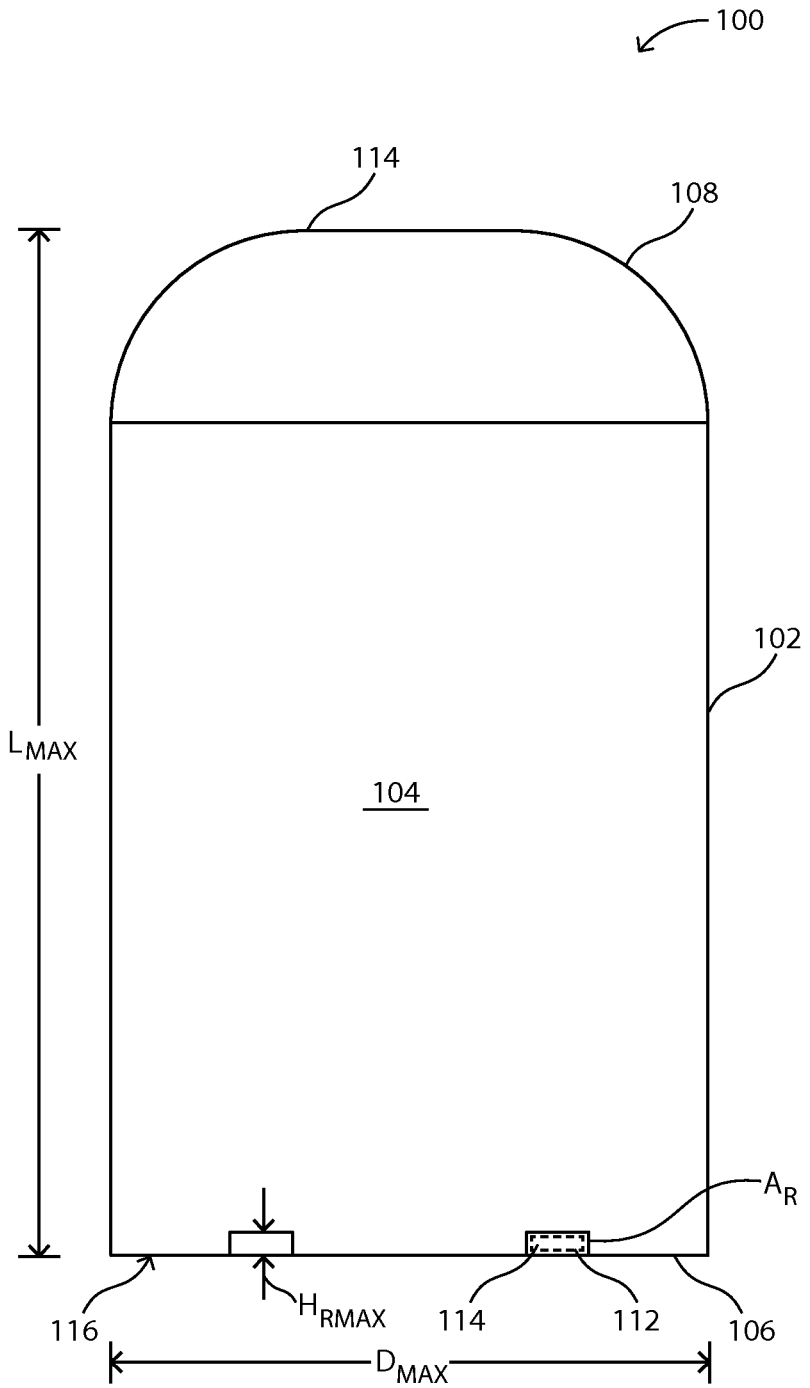
FIG. 2 includes a side view of a fluid flow sinker in accordance with an embodiment.
Figure 3:
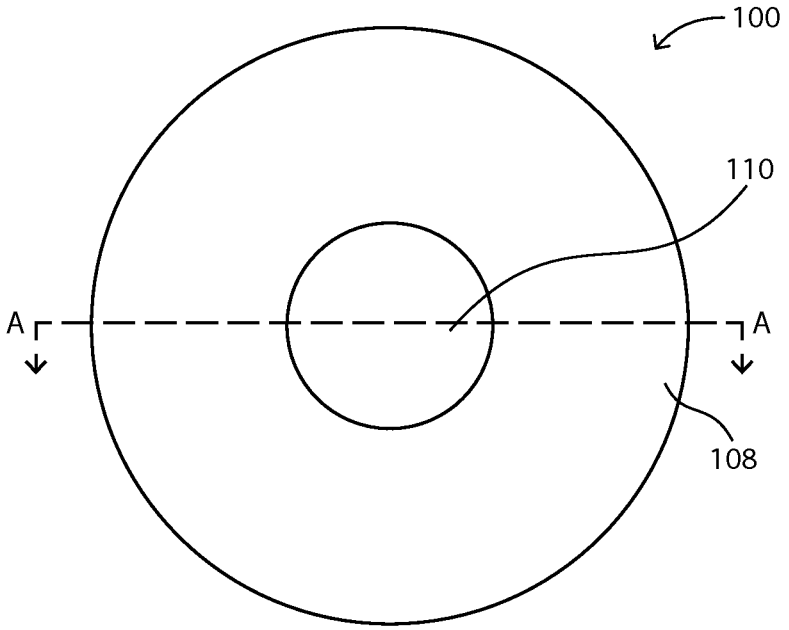
FIG. 3 includes a top view of a fluid flow sinker in accordance with an embodiment.

Referring initially to FIGS. 1 and 2, a fluid flow sinker 100 in accordance with embodiments described herein can generally include a body 102 having a generally cylindrical sidewall 104 defining a first end 106 and a second end 108. As used herein, the phrase "generally cylindrical sidewall" refers to a sidewall that does not deviate from a perfect cylinder at any surface location by more than 5%. For example, when viewed from a top view, the sidewall can have a first diameter at a first location, and a second diameter at a second location that is between 95% and 105% of the diameter as measured at the first location along the sidewall. When viewed from a top view, the generally cylindrical sidewall 104 can be slightly oblong, or eccentric.

In a further embodiment, when viewed from a side view, the generally cylindrical sidewall 104 can have a first diameter as measured at a first location, e.g., the first end 106, and a second diameter as measured at a second location, e.g., the second end 108, and the first and second diameters can differ by no greater than 5%. In such a manner, the generally cylindrical sidewall can be frustoconical, hour glass-shaped, or can have any other suitable configuration. As discussed in greater detail below, such a configuration may increase the volume of fluid that can be removed from a vessel.

The fluid flow sinker 100 can have a maximum diameter, $D_{MAX}$, as measured by a maximum distance extending between diametrically opposite locations of the generally cylindrical sidewall 104, and a maximum length, $L_{MAX}$, as measured by a maximum distance between the first and second ends 106 and 108. In particular embodiments $L_{MAX}/D_{MAX}$ can be no less than 1.25, such as no less than 1.5, no less than 1.75, no less than 2.0, no less than 2.5, no less than 3.0, no less than 4.0, or even no less than 5.0. In further embodiments, $L_{MAX}/D_{MAX}$ can be no greater than 10.0, such as no greater than 8.0, or even no greater than 6.0. Moreover, $L_{MAX}/D_{MAX}$ can be within a range between and including any of the values described above, such as, for example, between 4.0 and 4.5.

In certain embodiments, a surface 116 of the first end 106 of the body 102 can be generally flat. As used herein, "generally flat" refers to a surface having all point locations along the surface deviate by no greater than 5%. In further embodiments, the surface 116 can be pitted, dimpled, or otherwise contoured. In other embodiments, the surface 116 can be flat. As used herein, the term "flat" refers to a surface having no greater than a nominal surface deviation (e.g., less than about 0.1%) as caused by acceptable tolerances exhibited during normal manufacturing processes, e.g., normal surface roughness.

In particular embodiments, the second end 108 can be at least partially outwardly rounded. In further embodiments, such as illustrated in FIG. 2, the second end 108 can include a flat portion 114 extending substantially perpendicular to the generally cylindrical sidewall 104. The flat portion 114 can facilitate easier assembly of a tube (not illustrated) with the fluid flow sinker 100. The shape of the first and second ends 106 and 108 are not intended to be limited by the examples described above. For example, the first end 106 can be flat, polygonal, arcuate, or any combination thereof. Moreover, the surface 116 of first end 106 can be disposed along a plane oriented at a non-right angle relative to the generally cylindrical sidewall 104. Similarly, the second end 108 can be flat, polygonal, arcuate, or any combination thereof. Moreover, the second end 108 can be disposed along a plane oriented at a relative angle as measured against the first end 106, or disposed parallel thereto.

Figure 4:
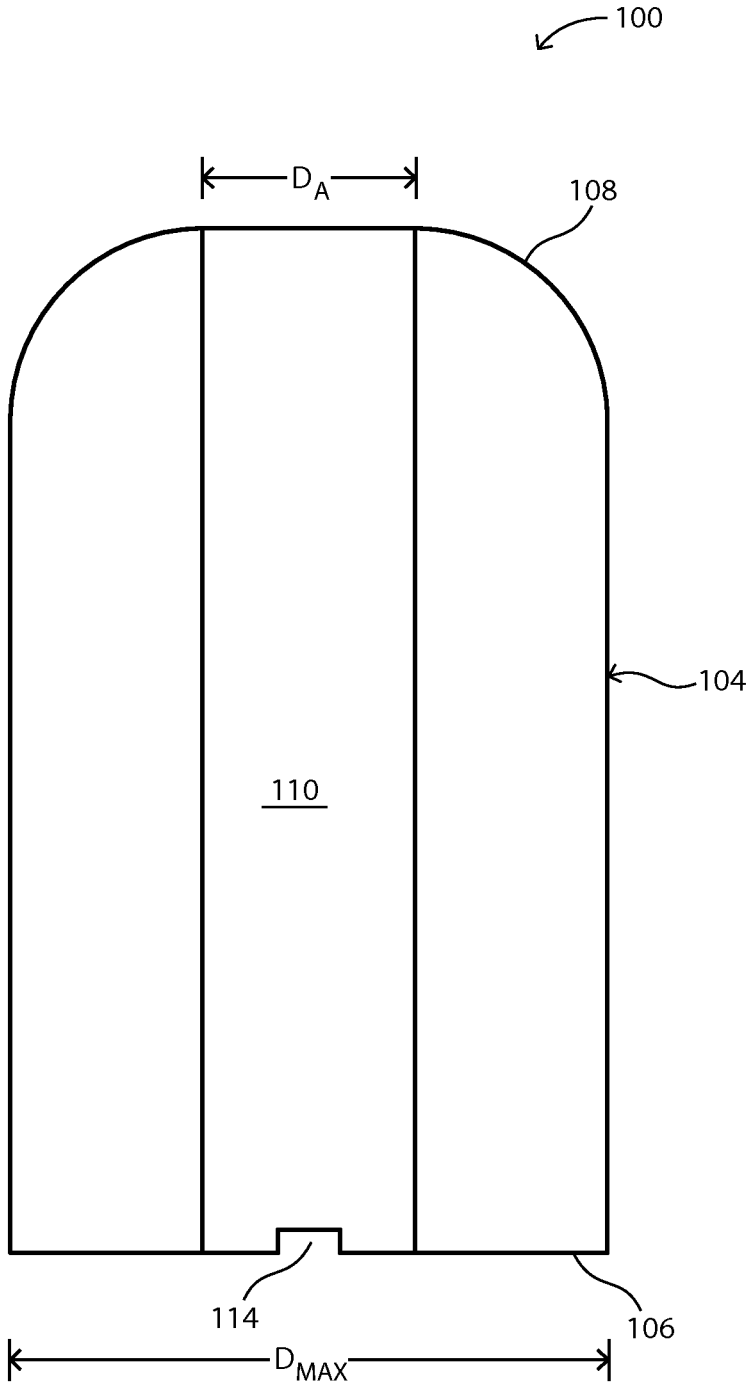
FIG. 4 includes a cross-sectional side view of a fluid flow sinker in accordance with an embodiment, as seen along Line A-A in FIG. 3.

Referring now to FIG. 4, an aperture 110 can extend between the first and second ends 106 and 108. In a particular embodiment, the aperture 110 can extend perpendicular to the flat portion 114 of the second end 108. In another embodiment, the aperture 110 can be disposed at a nonparallel angle as compared to the flat portion 114. In such a manner, the aperture 110 can be particularly oriented for different applications. For example, the aperture can be oriented specifically for those applications in which a fluid is withdrawn from a particular location of a vessel, e.g., a crevice, a toroidal cavity, a recess, or an eccentric surface.

In a non-illustrated embodiment, the aperture can extend between one of the first and second ends and the generally cylindrical sidewall. In such a manner, the aperture can form a relative angle with the first end of the body. In such a manner, the aperture does not pass between opposing ends of the fluid flow sinker.

The aperture 110 can define an average diameter, $D_A$, through which a fluid can pass. In particular embodiments, $D_{MAX}/D_A$ can be at least 1.1, such as at least 1.2, at least 1.3, at least 1.4, at least 1.5, at least 1.75, or even at least 2.0. In further embodiments, $D_{MAX}/D_A$ can be no greater than 4.0, such as no greater than 3.5, no greater than 3.0, no greater than 2.5, or even no greater than 2.25. Moreover, $D_{MAX}/D_A$ can be within a range between and including any of the values described above, such as, for example, between 1.3 and 1.6. A person of ordinary skill will understand that as $D_{MAX}/D_A$ increases, the relative weight of the fluid flow sinker 100 to the maximum fluid flow through the aperture 110 increases. Conversely, as $D_{MAX}/D_A$ decreases, the generally cylindrical sidewall 104 of the body 102 can weaken such that the fluid flow sinker 100 collapses during operation. Therefore, in a particular embodiment, $D_{MAX}/D_A$ is between 1.1 and 2.5, such as between 1.2 and 1.7, or even between 1.3 and 1.5.

Figure 5:
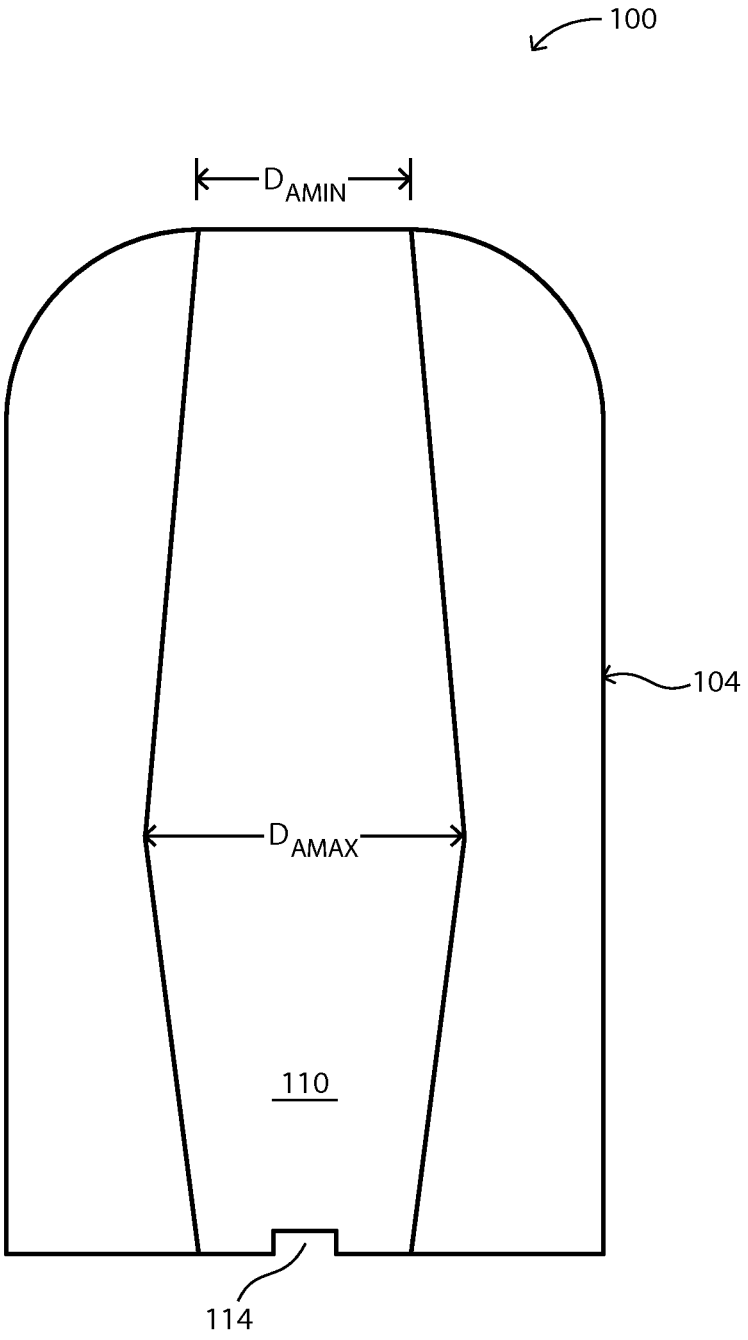
FIG. 5 includes a cross-sectional side view of a fluid flow sinker in accordance with an alternate embodiment, as seen along Line A-A in FIG. 3.

In a particular embodiment, the diameter, $D_A$, of the aperture 110 can be constant, as measured along a length of the aperture 110. In another embodiment, the diameter of the aperture 110 can vary along a length of the aperture 110. For example, as illustrated in FIG. 5, the aperture 110 can have a maximum diameter, $D_{AMAX}$, and a minimum diameter, $D_{AMIN}$, where $D_{AMAX}$ is no greater than 1.5 $D_A$, and $D_{AMIN}$ is no less than 0.5 $D_A$. Furthermore, $D_{AMAX}$ can be no greater than 1.4 $D_A$, such as no greater than 1.3 $D_A$, no greater than 1.2 $D_A$, or even no greater than 1.1 $D_A$. $D_{AMIN}$ can be no less than 0.6 $D_A$, such as no less than 0.7 $D_A$, no less than 0.8 $D_A$, or even no less than 0.9 $D_A$. Moreover the values for $D_{AMAX}$ and $D_{AMIN}$ can be within a range between and including any of the values described above with respect to $D_A$.

Figure 6:
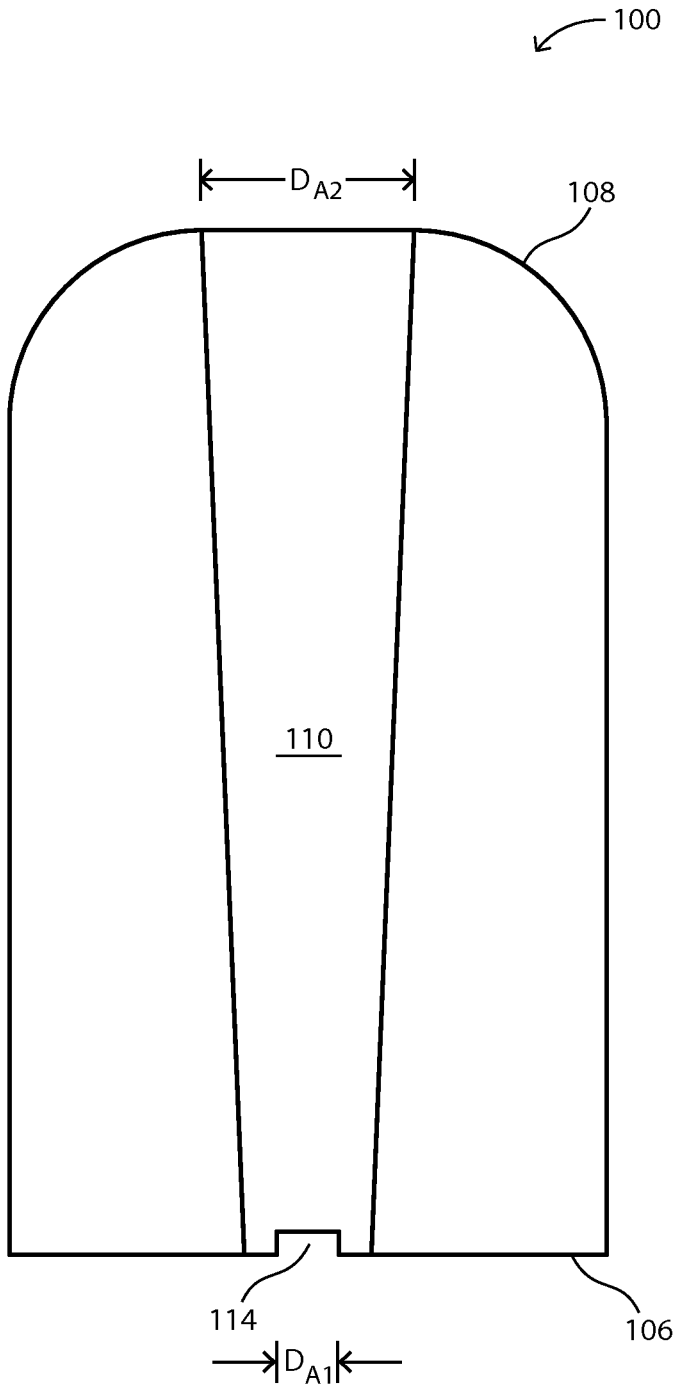
FIG. 6 includes a cross-sectional side view of a fluid flow sinker in accordance with an alternate embodiment, as seen along Line A-A in FIG. 3.

In a further embodiment, the aperture 110 can have a gradually increasing diameter. For example, as illustrated in FIG. 6, the aperture 110 can have a diameter, $D_{A1}$, at the first end 106, and a diameter $D_{A2}$, at the second end 108. $D_{A2}$ can be at least 1.05 $D_{A1}$, such as at least 1.1 $D_{A1}$, or even at least 1.2 $D_{A1}$. Moreover, $D_{A2}$ can be no greater than 1.5 $D_{A1}$, such as no greater than 1.4$D_{A1}$, or even no greater than 1.3 $D_{A1}$. Alternatively, $D_{A1}$ can be at least 1.05 $D_{A2}$, such as at least 1.1 $D_{A2}$, or even at least 1.2 $D_{A2}$. Moreover, $D_{A1}$ can be no greater than 1.5 $D_{A2}$, such as no greater than 1.4$D_{A2}$, or even no greater than 1.3 $D_{A2}$.

A person of ordinary skill will understand that an aperture having a constant, or nearly constant, diameter may cause a more laminar fluid flow which may reduce aspiration of the fluid being passed therethrough. Alternatively, an aperture having a varying diameter may cause a turbulent fluid flow which may result in increased aspiration of the fluid. Certain fluids, e.g., certain pharmaceuticals, are susceptible to damage upon subjection to turbulent fluid flow. Therefore, selection of the proper aperture diameter and shape may be dependent upon application.

In certain embodiments, the body 102 of the fluid flow sinker 100 can comprise a material having an average density, as measured at 39° F., of no less than 1.0 g/cm$^3$, such as no less than 1.05 g/cm$^3$, no less than 1.1 g/cm$^3$, no less than 1.15 g/cm$^3$, no less than 1.2 g/cm$^3$, no less than 1.25 g/cm$^3$, or even no less than 1.3 g/cm$^3$. In further embodiments, the body 102 can comprise a material having an average density, as measured at 39° F., of no greater than 10.0 g/cm$^3$, such as no greater than 8.0 g/cm$^3$, no greater than 5.0 g/cm$^3$, no greater than 3 g/cm$^3$, or even no greater than 2.0 g/cm$^3$. Moreover, the body 102 of the fluid flow sinker 100 can comprise a material having an average density within a range between and including any of the values described above, such as, for example, between 2.1 g/cm$^3$ and 3.1 g/cm$^3$.

In certain embodiments, the fluid flow sinker 100 can have a total mass of less than 500 grams, such as less than 400 grams, less than 300 grams, less than 200 grams, or even less than 100 grams. In further embodiments, the fluid flow sinker 100 can have a total mass of at least 5 grams, such as at least 20 grams, at least 40 grams, or even at least 75 grams. Moreover, the fluid flow sinker 100 can have a mass within a range between and including any of the values described above, such as, for example, between 90 grams and 150 grams. The density of the fluid flow sinker 100 may be important during fluid flow operations, e.g., filling or emptying of a vessel. Specifically, by having an average density greater than the density of water (or the fluid into which the fluid flow sinker is submerged), the fluid flow sinker 100 can sink, allowing for more complete fluid removal from the vessel.

In a particular embodiment, the fluid flow sinker 100 can at least partially comprise a polymer. Exemplary polymers can include, for example, a polyketone, a polyaramid, a polyimide, a polytherimide, a polyphenylene sulfide, a polyethersulfone, a polysulfone, a polyphenylene sulfone, a polyamideimide, ultra high molecular weight polyethylene, a fluoropolymer, a polyamide, a polybenzimidazole, or any combination thereof.

An example fluoropolymer can include a fluorinated ethylene propylene (FEP), a polytetrafluoroethylene (PTFE), a polyvinylidene fluoride (PVDF), a perfluoroalkoxy (PFA), a terpolymer of tetrafluoroethylene, a hexafluoropropylene, and a vinylidene fluoride (THV), a polychlorotrifluoroethylene (PCTFE), an ethylene tetrafluoroethylene copolymer (ETFE), an ethylene chlorotrifluoroethylene copolymer (ECTFE), or any combination thereof.

In another embodiment, the fluid flow sinker 100 can at least partially comprise a metal. In yet a further embodiment, the fluid flow sinker 100 can at least partially comprise an alloy. It may be desirable in certain applications for the fluid flow sinker 100 to comprise a polymer/metal combination. In particular, a polymer body can be overmolded or otherwise attached to a metal component, thereby increasing the average density of the fluid flow sinker. In certain embodiments, the fluid flow sinker can include an outer layer adapted to prevent caustic or otherwise damaging chemical reactions between the body of the fluid flow sinker and the fluid into which the fluid flow sinker is positioned.

Referring again to FIGS. 1 and 2, in particular embodiments, the fluid flow sinker 100 can further include a fluid passageway 112 disposed on the first end 106 of the body 102 and extending radially from the generally cylindrical sidewall 104 to the aperture 110.

Figure 7:
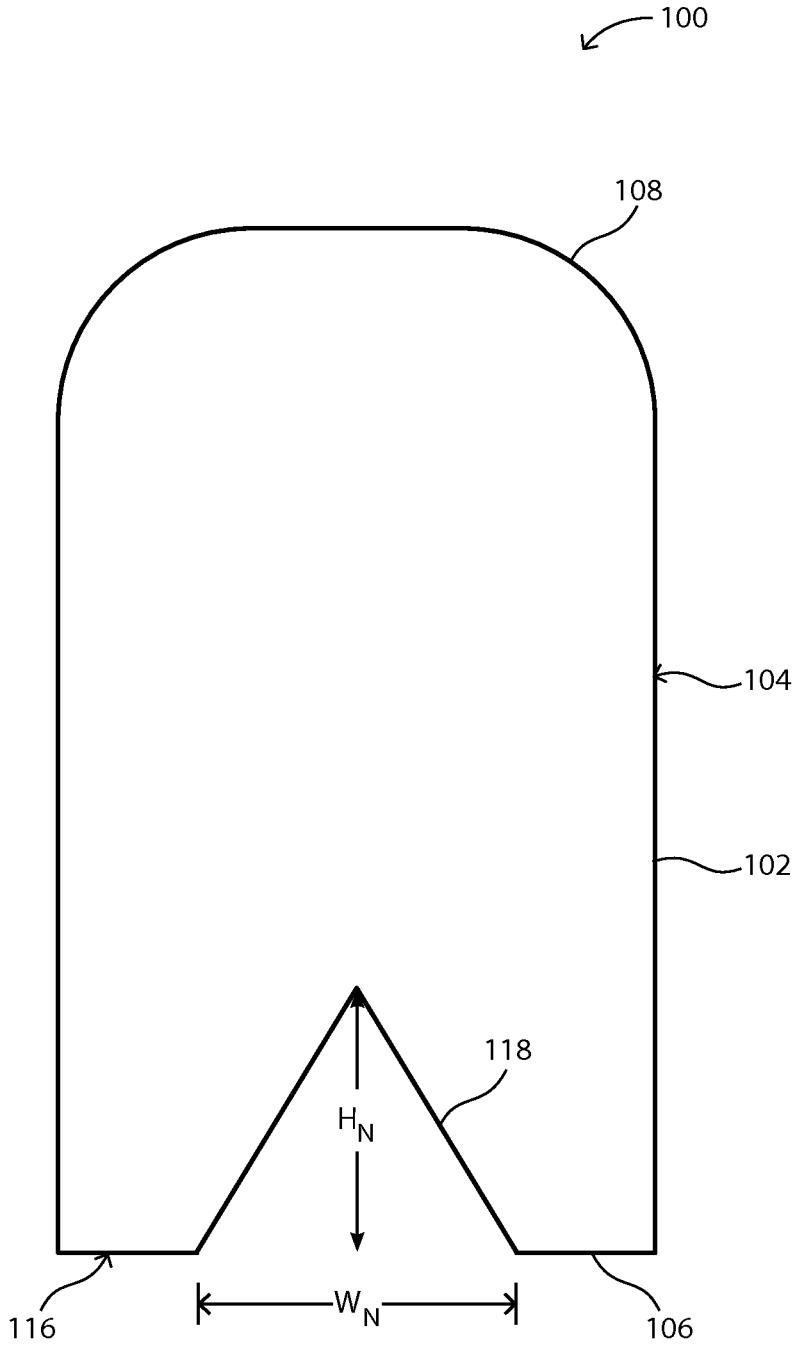
FIG. 7 includes a side view of a fluid flow sinker in accordance with an alternate embodiment.

As illustrated in FIGS. 1 and 2, the fluid passageway 112 can include a recess 114 extending from the surface 116 of the first end 106 of the body 102 a distance into the body 102. When viewed from a side view, as illustrated in FIG. 2, the recess 114 can have a polygonal cross-sectional profile (e.g., a triangular cross-sectional profile, a pentagonal cross-sectional profile, a hexagonal cross-sectional profile, etc.). More specifically, in a particular embodiment, the recess 114 can have a rectangular cross-sectional profile. As illustrated in FIG. 7, in a particular embodiment, the recess 112 can include a V-shaped notch 118 extending from the surface 116 of the first end 106 into the body 102 of the fluid flow sinker 100. The notch 118 can have an aspect ratio, as defined by the maximum height, $H_N$, of the notch 118 as compared to the maximum width, $W_N$, of the notch 118, of at least 1.25, such as at least 1.5, at least 1.75, at least 2.0, at least 2.25, at least 2.5, or even at least 3.0. In such a manner, the notch 118 can have a greater height than width. In yet a further embodiment, when viewed from a side view, the recess 114 can have an ellipsoidal, or arcuate, cross-sectional profile.

Referring again to FIG. 2, in particular embodiments, the rectangular recess 114 can define a maximum height, $H_{RMAX}$, as measured from the surface 116 of the first end 106 of the body 102. In particular embodiments $L_{MAX}/H_{RMAX}$ can be at least 2.0, such as at least 3.0, at least 4.0, at least 5.0, at least 6.0, at least 7.0, at least 8.0, at least 9.0, at least 10.0, at least 15.0, at least 20.0, at least 25.0, at least 30.0, or even at least 50.0. In further embodiments, $L_{MAX}/H_{RMAX}$ can be no greater than 500, such as no greater than 400, no greater than 300, no greater than 200, no greater than 100, or even no greater than 75. Moreover, $L_{MAX}/H_{RMAX}$ can be within a range between and including any of the above described values, such as, for example, between 10.0 and 15.0. Increasing $H_{RMAX}$ may enhance maximum fluid flow of a fluid through the recess 114 in conditions where the fluid flow sinker 100 becomes stuck against a sidewall of a vessel. However, a recess 114 having too large of an $H_{RMAX}$ may simultaneously reduce the total volume of fluid which can be removed from the vessel and increase aspiration of the fluid.

When viewed in cross section, the recess 114 can define a cross-sectional area, $A_R$. In particular embodiments, the cross-sectional area of the recess 114 can be greater than 0.1 in$^2$, such as greater than 0.2 in$^2$, greater than 0.3 in$^2$, greater than 0.4 in$^2$, or even greater than 0.5 in$^2$. In further embodiments, the recess can have a cross-sectional area of less than 2.0 in$^2$, such as less than 1.0 in$^2$, less than 0.75 in$^2$, or even less than 0.6 in$^2$. Moreover, the cross-sectional area of the recess 114 can be within a range between and including any of the values above, such as, for example, between 0.15 in$^2$ and 0.50 in$^2$.

Figure 8:
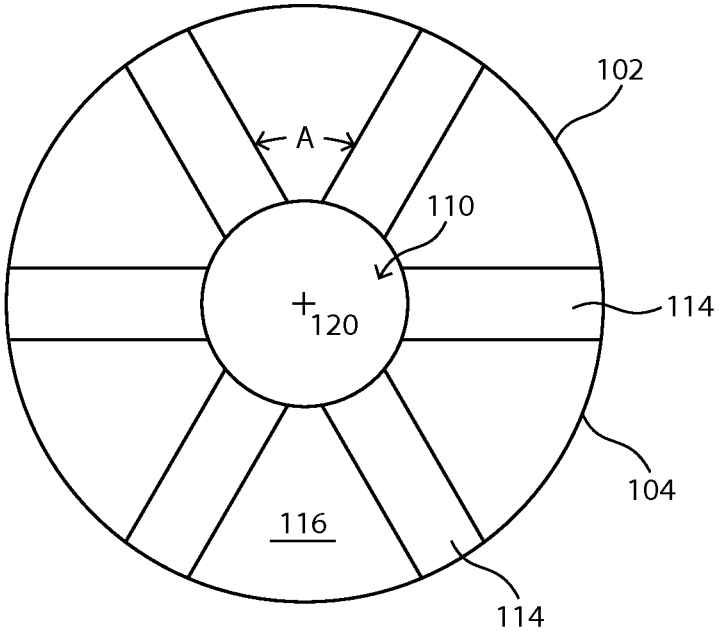
FIG. 8 includes a bottom view of a fluid flow sinker in accordance with an embodiment.

As illustrated in FIGS. 1, 2, and 8, in particular embodiments, the fluid flow sinker 100 can include a plurality of recesses 114 extending along the surface 116 of the first end 106 of the body 102 a distance into the body 102. In certain embodiments, each of the recesses 114 can have any number of similar characteristics to the recess 114 described above. For example, each recess 114 can have a polygonal cross-sectional profile or an $L_{MAX}/H_{RMAX}$ between 10.0 and 15.0. Alternatively, each recess can have any number of different characteristic, e.g., different $H_{RMAX}$ or different cross-sectional profiles.

Figure 9:
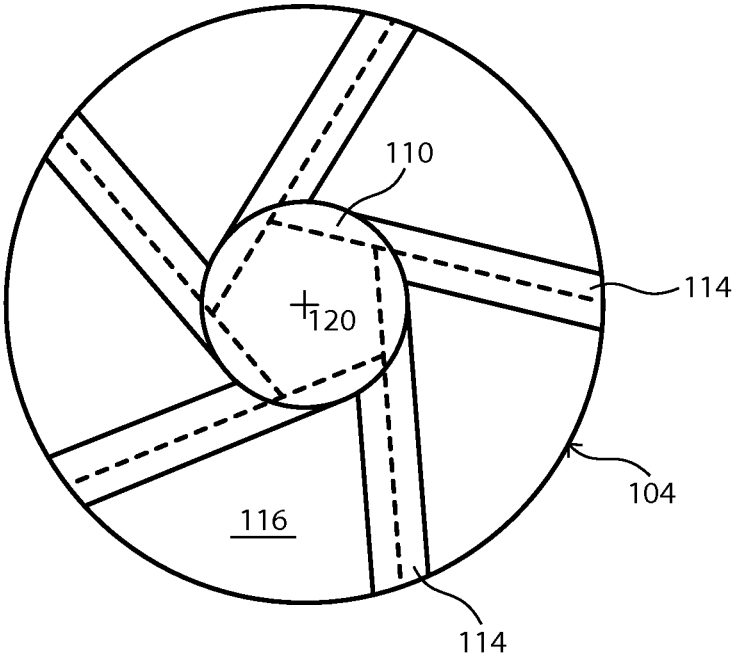
FIG. 9 includes a bottom view of a fluid flow sinker in accordance with an alternate embodiment.

As illustrated in FIG. 8, in a particular embodiment, each recess 114 can extend radially from the aperture 110 to the generally cylindrical sidewall 104 of the body 102. In certain embodiments, each recess 114 can extend from a central axis 120 of the fluid flow sinker 100 (FIG. 8). In such a manner, each recess 114 can be offset by a relative angle, A, therebetween. In particular embodiments, the angle, A, can be equal between adjacent recesses 114. In such a manner, when viewed from the first end, the plurality of recesses 114 can form a starburst pattern on the first end 106. In other embodiments, the angle, A, can be different between adjacent recesses 114. In alternative embodiments, each recess 114 can be offset from the central axis 120, i.e., the recesses 114 can lie along a straight line that does not intersect the central axis 120 (FIG. 9).

In particular embodiments, when viewed from the first end, each of the recesses can lie along a straight line. In other embodiments, when viewed from the first end, each of the recesses can lie along an at least partially ellipsoidal line. In yet further embodiments, when viewed from the first end, each of the recesses can have a plurality of segments disposed at relative angles with respect to each other.

Figure 10:
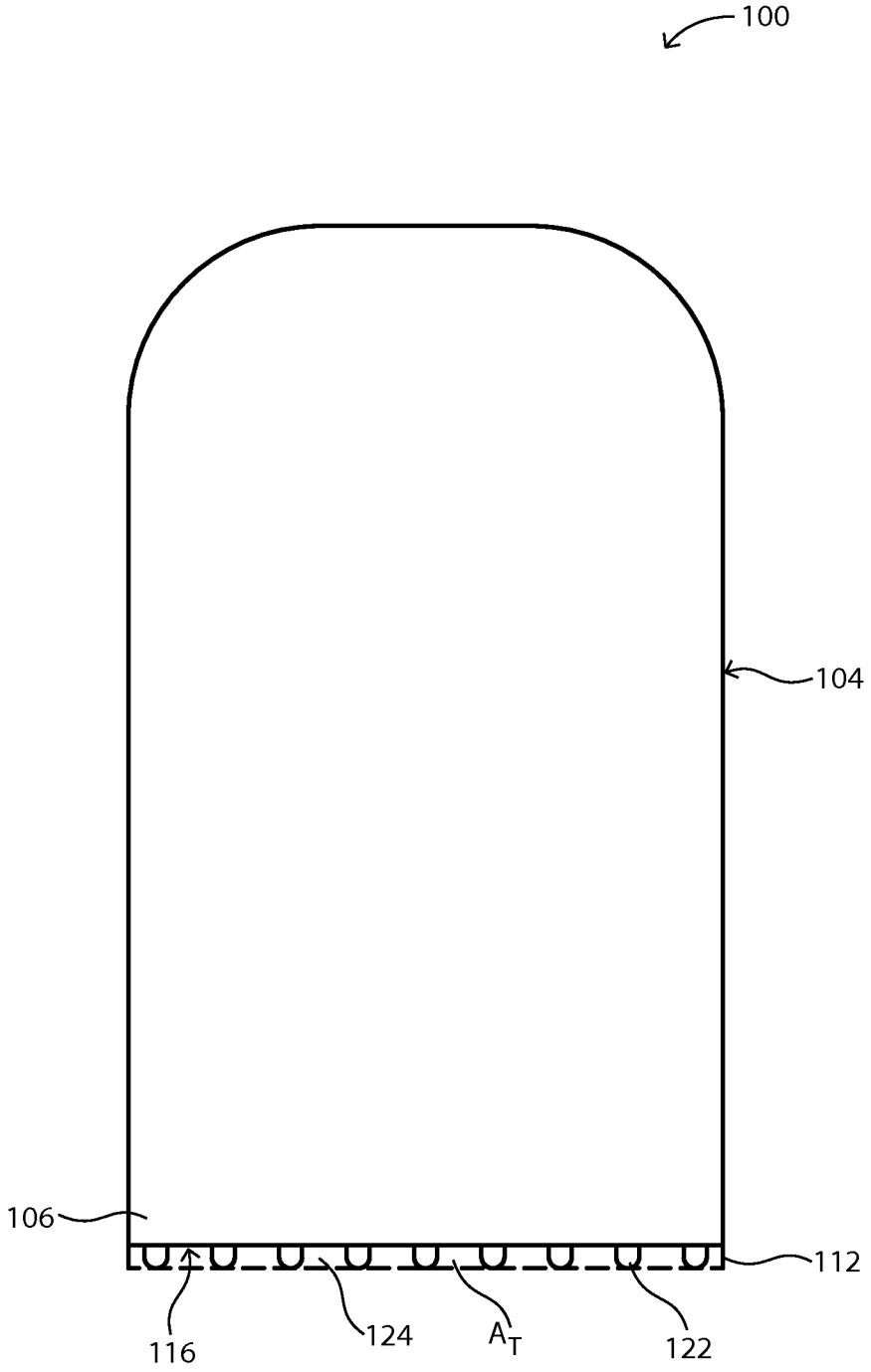
FIG. 10 includes a side view of a fluid flow sinker in accordance with an alternate embodiment.
Figure 11:
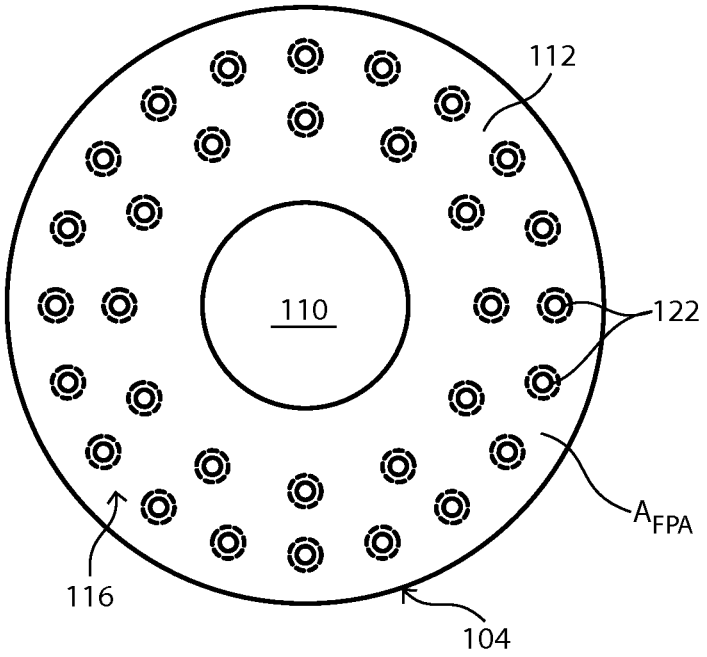
FIG. 11 includes a bottom view of a fluid flow sinker in accordance with an alternate embodiment.

As illustrated in FIGS. 10 and 11, in another embodiment, the fluid flow sinker 100 can include a plurality of projections 122 extending from the surface 116 of the first end 106. In such a manner, the fluid passageway 112 can comprise a fluid passage area 124 as defined by the total area of the first end 106 of the fluid flow sinker 110 free of projections 122 within an area bound between the surface 116 of the first end 106, a plane formed by the generally cylindrical sidewall 104, and a plane formed at a distal surface of the plurality of projections 122.

In particular, the fluid passageway 112 can define a volumetric area, $A_{FPA}$, as measured by the volume the fluid passage area 112 excluding the projections 122 located within the dashed lines. The total area, as measured between the surface 116 of the first end 106, a plane formed by the generally cylindrical sidewall 104, and a plane formed at a distal surface of the plurality of projections 122, can define a volumetric area, $A_T$. In particular embodiments, $A_{FPA}$ can be no less than 0.05 $A_T$, such as no less than 0.1 $A_T$, no less than 0.25 $A_T$, no less than 0.5 $A_T$, no less than 0.75 $A_T$, or even no less than 0.9 $A_T$. In further embodiments, $A_{FPA}$ can be less than 1 $A_T$, such as less than 0.98 $A_T$, less than 0.96 $A_T$, less than 0.94 $A_T$, less than 0.92 $A_T$, or even less than 0.90 $A_T$. Moreover, $A_{FPA}$ can be within a range between and including any of the values described above, such as, for example, between 0.80 $A_T$ and 0.90 $A_T$. A person of ordinary skill will understand that as $A_{FPA}$ increases relative to $A_T$, the volumetric flow rate of a fluid through the passageway 112 can increase. However, this increase can reduce structural integrity of the projections 122 by reducing the size thereof. Hence, in a more particular embodiment, $A_{FPA}$ can be no greater than 0.90 $A_T$.

Figure 12:
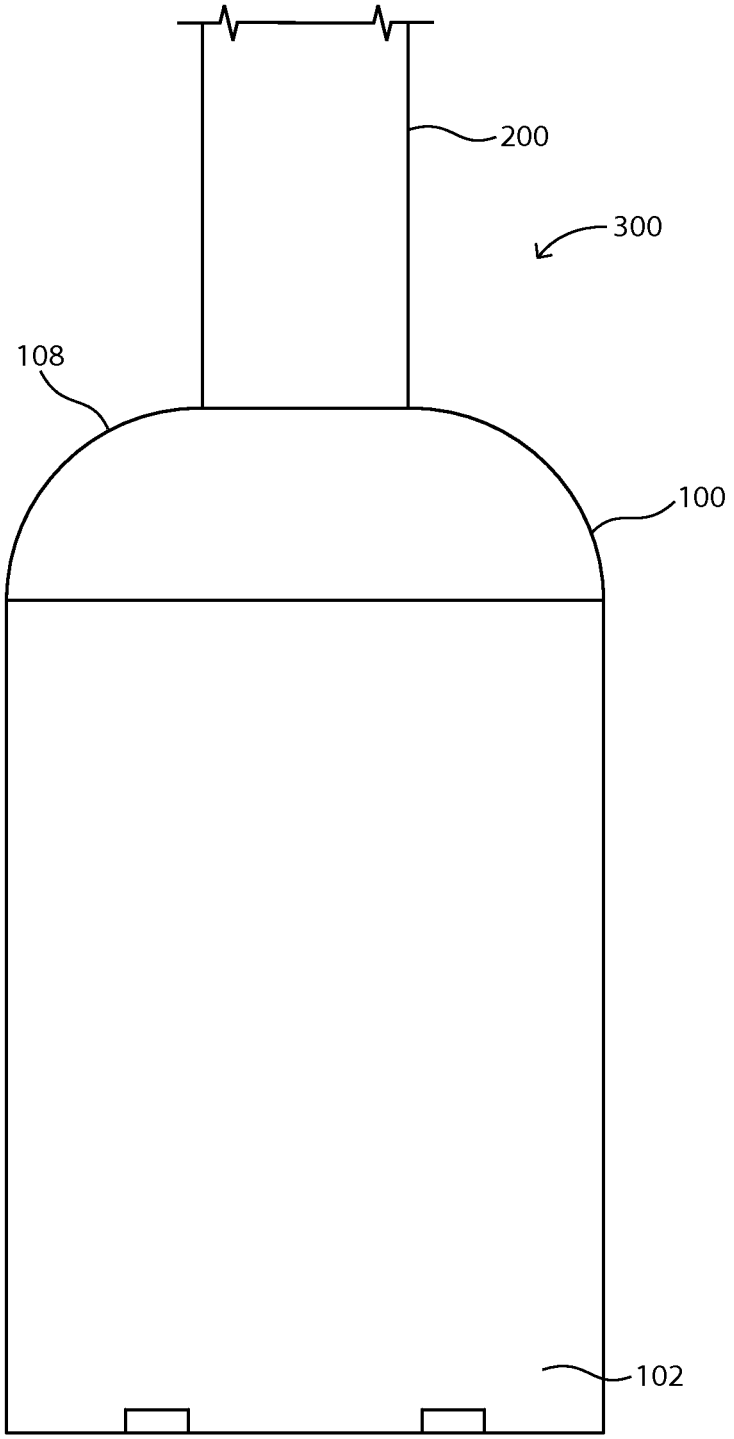
FIG. 12 includes a side view of a fluid flow sinker assembly in accordance with an embodiment.

As contemplated herein, and as illustrated in FIG. 12, in certain embodiments the fluid flow sinker 100 can be attached to a tube 200 to form a fluid flow sinker assembly 300. In such a manner, the aperture 110 of the fluid flow sinker 100 can be in fluid communication with the tube 200. More specifically, the tube 200 can be in communication with the aperture 110 at the second end 108 of the fluid flow sinker 100.

In particular embodiments, the tube 200 can be threaded to the body 102 of the fluid flow sinker 100. In other embodiments, the tube 200 can form an interference fit with the body 102 of the fluid flow sinker 100. In yet further embodiments, the tube 200 can be overmolded to the body 102 of the fluid flow sinker 100. In alternate embodiments, the tube 200 can be secured to the body 102 by a fastener or an adhesive.

Preferably, the tube 200 can be selected to have an internal opening that is equal, or almost equal, in diameter to the diameter of the aperture 110. As used herein, the phrase "almost equal" refers to a deviation between two objects of no greater than approximately 5%. For example, the tube 200 can have an internal diameter of approximately 1.0 inch and the aperture 110 can have an inner diameter of between approximately 0.95 inches and approximately 1.05 inches. In such a manner, a fluid can pass through the aperture 110 of the fluid flow sinker 100 and the tube 200 with a more laminar flow. This can reduce aspiration and damage to sensitive fluids being passed therethrough. In other embodiments, an internal diameter of the tube 200 can be larger or smaller than an internal diameter of the aperture 110.

A fluid flow sinker 100 or fluid flow sinker assembly 300 as contemplated herein is not intended to be limited to particular applications or assemblies. By way of non-limiting examples, the fluid flow sinker or fluid flow sinker assembly as contemplated in embodiments herein can be utilized in vessels for household fluids, the manufacturing of pharmaceutical components, or even industrial equipment.

As used herein, the phrase "flow effectiveness ratio" compares the fluid flow rate of a fluid through the fluid flow sinker in an ideal fluid flow situation, e.g., when the fluid flow sinker is positioned furthest from a surface of a vessel, and the fluid flow rate of the fluid through the fluid flow sinker in a worst fluid flow situation, e.g., when the aperture of the fluid flow sinker is disposed at a location adjacent a surface of the vessel. In other words, the flow effectiveness ratio is the ratio of the worst flow rate to the best flow rate of the fluid flow sinker. The fluid flow sinker 100 in accordance with embodiments herein can have a flow effectiveness ratio of no less than 25%, such as no less than 50%, no less than 75%, or even no less than 90%.

Figure 13:
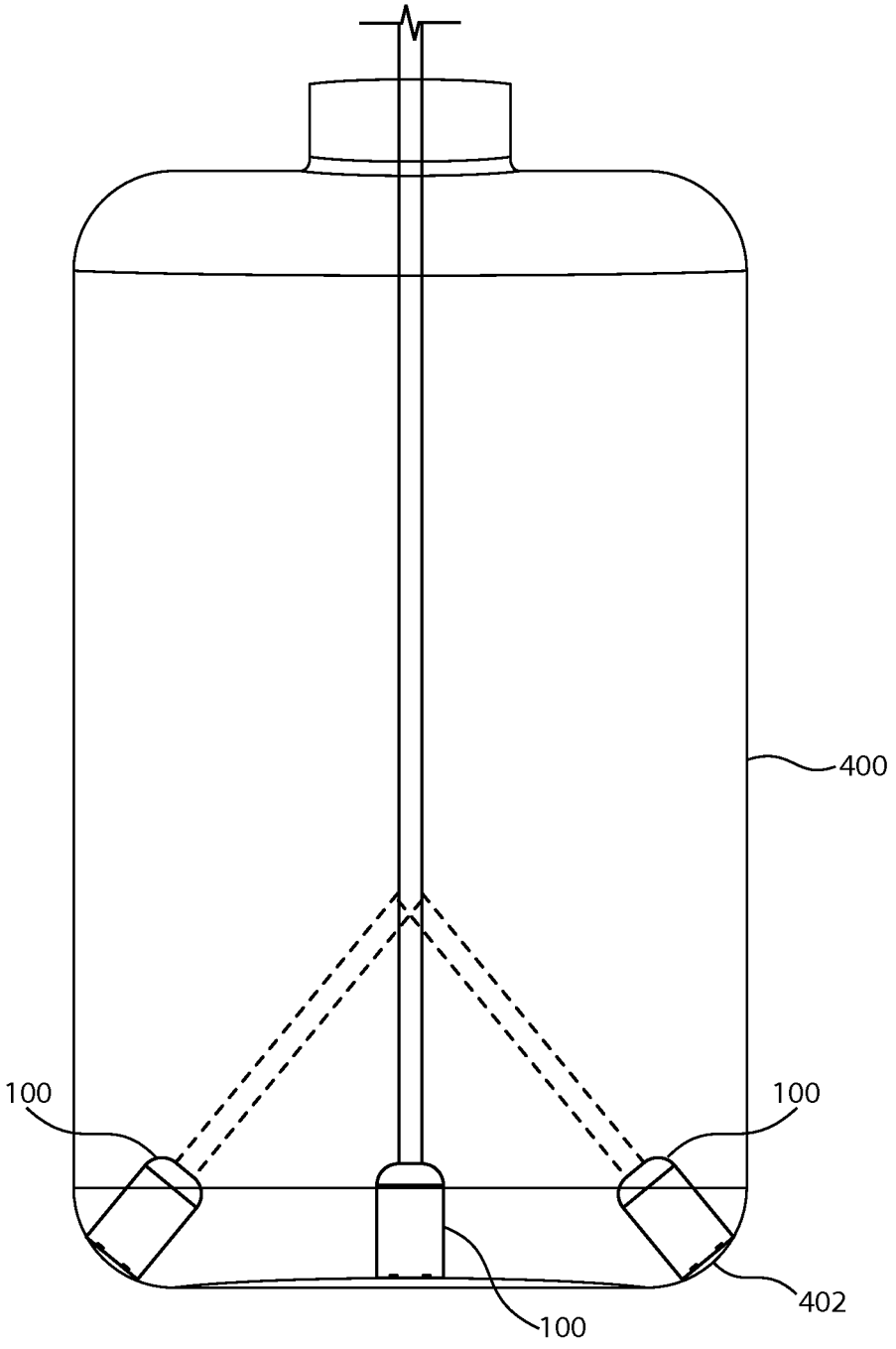
FIG. 13 includes a side view of a fluid flow sinker assembly disposed within a vessel in accordance with an embodiment.

As used herein, the phrase "fluid removal percentage" is a measure of the percentage of fluid that can be removed from a vessel. For example, in a vessel which can hold 1 Liter of fluid, removal of 0.95 Liters results in a fluid removal percentage of 95%. The fluid flow sinker 100 in accordance with embodiments herein can have a fluid removal percentage of no less than 90%, such as no less than 95%, no less than 98%, no less than 99%, no less than 99.5%, or even no less than 99.9%. A person of ordinary skill will recognize that the fluid removal percentage from a vessel can be a critical value when the fluid to be removed from the vessel is costly per unit volume. Therefore, a high fluid removal percentage is preferred. A fluid flow sinker 100 having a generally cylindrical sidewall, rather than a rounded, or spherical, sidewall may permit the fluid flow sinker 100 to have an increased fluid removal percentage, especially in non-flat bottomed vessels, as the aperture 110 can reach otherwise unreachable locations, e.g., a corner formed between a sidewall and a bottom surface of a vessel. For example, as illustrated in FIG. 13, a fluid flow sinker 100 in accordance with embodiments herein can reach into corners 402 of a vessel 400 into which a rounded body fluid flow sinker 100 would not otherwise be able to reach.

As used herein, the phrase "flow/size ratio" is a ratio of the maximum attainable volumetric flow as compared to the volumetric size of the fluid flow sinker. A high flow/size ratio indicates a high fluid flow rate relative to the volumetric size of the body of the fluid flow sinker, e.g., the body of the fluid flow sinker is small as compared to the aperture extending therethrough. A low flow/size ratio indicates a thick body or a small aperture. As contemplated herein, the fluid flow sinker 100 can have a flow/size ratio of no less than 1 $in^3$/sec:1.2 $in^3$.

As used herein, the term "cavitation" refers to the lateral movement, e.g., the X-Y plane movement, of the fluid flow sinker 100 while a fluid passes through the aperture thereof while the fluid flow sinker 100 is separated from a surface of the vessel. "Cavitation" can be measured by movement of the fluid flow sinker in a lateral direction as compared to the maximum diameter, $D_{MAX}$, of the body. In particular embodiments, the fluid flow sinker 100 can cavitate during a maximum fluid flow by a distance of no greater than 5.0 $D_{MAX}$, such as no greater than 4.0 $D_{MAX}$, no greater than 3.0 $D_{MAX}$, no greater than 2.0 $D_{MAX}$, or even no greater than 1.0 $D_{MAX}$. A person of ordinary skill will recognize that reduced cavitation of the fluid flow sinker during filling and unfilling of a vessel may reduce any damage to delicate fluids passing therethrough.

Many different aspects and embodiments are possible. Some of those aspects and embodiments are described below. After reading this specification, skilled artisans will appreciate that those aspects and embodiments are only illustrative and do not limit the scope of the present invention. Embodiments may be in accordance with any one or more of the items as listed below.

Item 1. A fluid flow sinker comprising:

a body having a generally cylindrical sidewall, a first end, a second end, and an aperture extending between the first and second ends; and a fluid passageway disposed on the first end and extending from the generally cylindrical sidewall to the aperture, wherein the fluid flow sinker is adapted to receive a tube in communication with the aperture.

Item 2. A fluid flow sinker comprising:

a body including:

a generally cylindrical sidewall having a first end and a second end;

an aperture extending between the first and second ends; and a fluid passageway disposed on the first end, the fluid passageway in communication with the aperture, wherein the first end is generally flat and the second end is outwardly rounded, and wherein the fluid flow sinker is adapted to receive a tube in communication with the aperture at the second end.

Item 3. A fluid flow sinker assembly comprising:

a fluid flow sinker including:

a body having a generally cylindrical sidewall, a first end, a second end, and an aperture extending between the first and second ends; and a fluid passageway disposed on the first end, the fluid passageway in communication with the aperture; and a tube in communication with the aperture at the second end.

Item 4. A fluid flow sinker adapted for use in the production of pharmaceuticals, the fluid flow sinker comprising a body having an aperture adapted to permit a fluid flow, wherein the fluid flow sinker has a fluid removal rate according to the Fluid Removal Test of no less than 95%, such as no less than 98%, no less than 99%, or even no less than 99.5%.

Item 5. A fluid flow sinker comprising a body having an aperture, wherein the fluid flow sinker comprises at least one of the following:

a flow effectiveness ratio of no less than 90%; and a fluid removal rate of no less than 95% as measured using the Fluid Removal Test.

Item 6. The fluid flow sinker or fluid flow sinker assembly according to any one of the preceding items, wherein the fluid flow sinker is adapted to permit a continuous fluid flow for a minimum duration of no less than 5 seconds, no less than 10 seconds, no less than 30 seconds, no less than 60 seconds, no less than 90 seconds, no less than 120 seconds, no less than 180 seconds, or no less than 300 seconds.

Item 7. The fluid flow sinker or fluid flow sinker assembly according to any one of the preceding items, wherein the fluid flow sinker is adapted to permit a continuous fluid flow for a maximum duration of no greater than 1000 seconds, no greater than 600 seconds, no greater than 420 seconds, or no greater than 360 seconds.

Item 8. The fluid flow sinker or fluid flow sinker assembly according to any one of the preceding items, wherein the fluid flow sinker comprises an average density, as measured at 39° F., of no less than 1.0 $g/cm^3$, no less than 1.05 $g/cm^3$, no less than 1.1 $g/cm^3$, no less than 1.15 $g/cm^3$, no less than 1.2 $g/cm^3$, no less than 1.25 $g/cm^3$, or no less than 1.3 $g/cm^3$.

Item 9. The fluid flow sinker or fluid flow sinker assembly according to any one of the preceding items, wherein the fluid flow sinker comprises an average density, as measured at 39° F., of no greater than 10.0 $g/cm^3$, no greater than 8.0 $g/cm^3$, no greater than 5.0 $g/cm^3$, no greater than 3 $g/cm^3$, or no greater than 2.0 $g/cm^3$.

Item 10. The fluid flow sinker or fluid flow sinker assembly according to any one of the preceding items, wherein the fluid flow sinker comprises a total mass of less than 500 g, less than 400 g, less than 300 g, less than 200 g, or less than 100 g.

Item 11. The fluid flow sinker or fluid flow sinker assembly according to any one of the preceding items, wherein the fluid flow sinker comprises a total mass of at least 5 g, at least 20 g, at least 40 g, at least 75 g.

Item 12. The fluid flow sinker or fluid flow sinker assembly according to any one of the preceding items, wherein the fluid flow sinker comprises an average density greater than the density of pure water.

Item 13. The fluid flow sinker or fluid flow sinker assembly according to any one of the preceding items, wherein the fluid flow sinker comprises a polymer.

Item 14. The fluid flow sinker or fluid flow sinker assembly according to any one of the preceding items, wherein the fluid flow sinker comprises a metal.

Item 15. The fluid flow sinker or fluid flow sinker assembly according to any one of the preceding items, wherein the fluid flow sinker has a maximum diameter, $D_{MAX}$, as measured across the generally cylindrical sidewall, and a maximum length, $L_{MAX}$, as measured between the first end and the second end, and wherein $L_{MAX}/D_{MAX}$ is no less than 1.25, no less than 1.5, no less than 1.75, no less than 2.0, no less than 2.5, no less than 3.0, no less than 4.0, or no less than 5.0.

Item 16. The fluid flow sinker or fluid flow sinker assembly according to item 13, wherein $L_{MAX}/D_{MAX}$ is no greater than 10.0, no greater than 8.0, or no greater than 6.0.

Item 17. The fluid flow sinker or fluid flow sinker assembly according to any one of the preceding items, wherein, when viewed in cross section, the generally cylindrical wall comprises a cylindrical wall.

Item 18. The fluid flow sinker or fluid flow sinker assembly according to any one of items 15-17, wherein the aperture has an average diameter, $D_A$, and wherein $D_{MAX}/D_A$ is at least 1.1, at least 1.2, at least 1.3, at least 1.4, at least 1.5, at least 1.75, or at least 2.0.

Item 19. The fluid flow sinker or fluid flow sinker assembly according to item 18, wherein $D_{MAX}/D_A$ is no greater than 4.0, no greater than 3.5, no greater than 3.0, no greater than 2.5, or no greater than 2.25.

Item 20. The fluid flow sinker or fluid flow sinker assembly according to any one of items 18 or 19, wherein the $D_A$ is constant, as measured along a length of the aperture.

Item 21. The fluid flow sinker or fluid flow sinker assembly according to any one of items 18 or 19, wherein $D_A$ varies along a length of the aperture.

Item 22. The fluid flow sinker or fluid flow sinker assembly according to item 21, wherein the aperture has a maximum diameter, $D_{AMAX}$, a minimum diameter, $D_{AMIN}$, and wherein $D_{AMAX}$ is no greater than 1.5 $D_A$, and $D_{AMIN}$ is no less than 0.5 $D_A$.

Item 23. The fluid flow sinker or fluid flow sinker assembly according to item 22, wherein $D_{AMAX}$ is no greater than 1.4 $D_A$, no greater than 1.3 $D_A$, no greater than 1.2 $D_A$, or no greater than 1.1 $D_A$.

Item 24. The fluid flow sinker or fluid flow sinker assembly according to any one of items 22 or 23, wherein $D_{AMIN}$ is no less than 0.6 $D_A$, no less than 0.7 $D_A$, no less than 0.8 $D_A$, or no less than 0.9 $D_A$.

Item 25. The fluid flow sinker or fluid flow sinker assembly according to any one of the preceding items, wherein the aperture has a length, $L_A$, wherein a first portion of the aperture has a diameter, $D_{A1}$, wherein a second portion of the aperture has a diameter $D_{A2}$, and wherein $D_{A2}$ is greater than $D_{A1}$.

Item 26. The fluid flow sinker or fluid flow sinker assembly according to item 25, wherein $D_{A2}$ is at least 1.05 $D_{A1}$, at least 1.1 $D_{A1}$, or at least 1.2 $D_{A1}$.

Item 27. The fluid flow sinker or fluid flow sinker assembly according to any one of items 25 or 26, wherein $D_{A2}$ is no greater than 1.5 $D_{A1}$, no greater than 1.4 $D_{A1}$, or no greater than 1.3 $D_{A1}$.

Item 28. The fluid flow sinker or fluid flow sinker assembly according to any one of items 25-27, wherein the first portion of the aperture is adjacent the first end of the body, and wherein the second portion of the aperture is adjacent the second end of the body.

Item 29. The fluid flow sinker or fluid flow sinker assembly according to any one of the preceding items, wherein the fluid flow sinker comprises a fluid passageway disposed on the first end and extending from the generally cylindrical sidewall to the aperture.

Item 30. The fluid flow sinker or fluid flow sinker assembly according to item 29, wherein the fluid passageway comprises a recess extending from the first end into the body.

Item 31. The fluid flow sinker or fluid flow sinker assembly according to item 30, wherein, when viewed in cross section, the recess has a polygonal profile.

Item 32. The fluid flow sinker or fluid flow sinker assembly according to any one of items 30 or 31, wherein, when viewed in cross section, the recess has a rectangular profile.

Item 33. The fluid flow sinker or fluid flow sinker assembly according to item 30, wherein, when viewed in cross section, the recess has an ellipsoidal profile.

Item 34. The fluid flow sinker or fluid flow sinker assembly according to any one of items 30-33, wherein the recess has a maximum height, $H_{RMAX}$, as measured from the first end, wherein the body comprises a maximum length, $L_{MAX}$, and wherein $L_{MAX}/H_{RMAX}$ is at least 2.0, at least 3.0, at least 4.0, at least 5.0, at least 6.0, at least 7.0, at least 8.0, at least 9.0, at least 10.0, at least 15.0, at least 20.0, at least 25.0, at least 30.0, or at least 50.0.

Item 35. The fluid flow sinker or fluid flow sinker assembly according to item 34, wherein $L_{MAX}/H_{RMAX}$ is no greater than 500, no greater than 400, no greater than 300, no greater than 200, no greater than 100, or no greater than 75.

Item 36. The fluid flow sinker or fluid flow sinker assembly according to any one of items 30-35, wherein, when viewed in cross section, the recess has a cross-sectional area greater than 0.1 $in^2$, greater than 0.2 $in^2$, greater than 0.3 $in^2$, greater than 0.4 $in^2$, or greater than 0.5 $in^2$.

Item 37. The fluid flow sinker or fluid flow sinker assembly according to any one of items 30-36, wherein, when viewed in cross section, the recess has a cross-sectional area of less than 2.0 $in^2$, less than 1.0 $in^2$, less than 0.75 $in^2$, or less than 0.6 $in^2$.

Item 38. The fluid flow sinker or fluid flow sinker assembly according to item 29, wherein the fluid passageway comprises a plurality of recesses extending from the first end into the body.

Item 39. The fluid flow sinker or fluid flow sinker assembly according to item 38, wherein, when viewed in cross section, each of the plurality of recesses has a polygonal profile.

Item 40. The fluid flow sinker or fluid flow sinker assembly according to any one of items 38 or 39, wherein, when viewed in cross section, each of the plurality of recesses has a rectangular profile.

Item 41. The fluid flow sinker or fluid flow sinker assembly according to item 38, wherein, when viewed in cross section, each of the plurality of recesses has an ellipsoidal profile.

Item 42. The fluid flow sinker or fluid flow sinker assembly according to any one of items 38-41, wherein, when viewed in cross section, each of the plurality of recesses has a different geometric profile.

Item 43. The fluid flow sinker or fluid flow sinker assembly according to any one of items 38-42, wherein each of the plurality of recesses has a maximum height, $H_{RMAX}$, as measured from the first end, wherein the body comprises a maximum length, $L_{MAX}$, and wherein $L_{MAX}/H_{RMAX}$ is at least 2.0, at least 3.0, at least 4.0, at least 5.0, at least 6.0, at least 7.0, at least 8.0, at least 9.0, at least 10.0, at least 15.0, at least 20.0, at least 25.0, at least 30.0, or at least 50.0.

Item 44. The fluid flow sinker or fluid flow sinker assembly according to item 43, wherein $L_{MAX}/H_{RMAX}$ is no greater than 500, no greater than 400, no greater than 300, no greater than 200, no greater than 100, or no greater than 75.

Item 45. The fluid flow sinker or fluid flow sinker assembly according to any one of items 38-44, wherein, when viewed in cross section, each of the plurality of recesses has a cross-sectional area greater than 0.1 $in^2$, greater than 0.2 $in^2$, greater than 0.3 $in^2$, greater than 0.4 $in^2$, or greater than 0.5 $in^2$.

Item 46. The fluid flow sinker or fluid flow sinker assembly according to any one of items 38-45, wherein, when viewed in cross section, each of the plurality of recesses has a cross-sectional area of less than 2.0 $in^2$, less than 1.0 $in^2$, less than 0.75 $in^2$, or less than 0.6 $in^2$.

Item 47. The fluid flow sinker or fluid flow sinker assembly according to any one of items 38-46, wherein, when viewed in cross section, each of the plurality of recesses has a different cross-sectional area.

Item 48. The fluid flow sinker or fluid flow sinker assembly according to any one of items 38-47, wherein each of the plurality of recesses is disposed at a relative angle, A, with respect to the adjacent recess, and wherein A is equal between each adjacent recess.

Item 49. The fluid flow sinker or fluid flow sinker assembly according to any one of items 38-48, wherein each of the plurality of recesses is disposed at a relative angle, A, with respect to the adjacent recess, and wherein A is different between each adjacent recess.

Item 50. The fluid flow sinker or fluid flow sinker assembly according to any one of items 38-49, wherein, when viewed from the first end, the plurality of recesses forms a starburst pattern.

Item 51. The fluid flow sinker or fluid flow sinker assembly according to item 29, wherein the first end comprises a plurality of projections extending therefrom, and wherein the fluid passageway comprises a fluid passage area free of projections, as defined within a total area as measured between the first end, the generally cylindrical sidewall, and a plane formed at a distal surface of the plurality of projections.

Item 52. The fluid flow sinker or fluid flow sinker assembly according to item 51, wherein the fluid passage area has a volumetric area, $A_{FPA}$, wherein the total area has a volumetric area, $A_T$, and wherein $A_{FPA}$ is no less than 0.05 $A_T$, no less than 0.1 $A_T$, no less than 0.25 $A_T$, no less than 0.5 $A_T$, no less than 0.75 $A_T$, or no less than 0.9 $A_T$.

Item 53. The fluid flow sinker or fluid flow sinker assembly according to item 52, wherein $A_{FPA}$ is less than 1 $A_T$, less than 0.98 $A_T$, less than 0.96 $A_T$, less than 0.94 $A_T$, less than 0.92 $A_T$, or less than 0.90 $A_T$.

Item 54. The fluid flow sinker or fluid flow sinker assembly according to any one of the preceding items, wherein the fluid flow sinker has a fluid removal rate as measured according to the Fluid Removal Test of no less than 95%, such as no less than 98%, no less than 99%, or even no less than 99.5%.

Item 55. The fluid flow sinker or fluid flow sinker assembly according to any one of the preceding items, wherein the fluid flow sinker has a flow effectiveness ratio of no less than 25%, such as no less than 50%, no less than 75%, or even no less than 90%.

Item 56. The fluid flow sinker or fluid flow sinker assembly according to any one of the preceding items, wherein the fluid flow sinker is adapted to remove a fluid from a vessel upon application of a negative pressure in the aperture.

Item 57. The fluid flow sinker or fluid flow sinker assembly according to any one of the preceding items, wherein the second end of the fluid flow sinker is adapted such that the aperture remains in fluid communication with a fluid disposed in a vessel when a surface of the second end is oriented in a direction coplanar with a portion of a sidewall of a vessel.

The above-disclosed subject matter is to be considered illustrative, and not restrictive, and the claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

In addition, in the foregoing detailed description, various features can be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter can be directed to less than all features of any of the disclosed embodiments. Thus, the following claims are incorporated into the detailed description, with each claim standing on its own as defining separately claimed subject matter.

What is claimed is:

1. A fluid flow sinker comprising:

a body having a first end of the body and an at least partially outwardly rounded second end of the body, wherein the entirety of the body from the first end to the second end has a cylindrical sidewall, and an aperture extending between the first and second ends of the body; and a fluid passageway disposed on the first end and extending from the cylindrical sidewall to the aperture, wherein the fluid flow sinker is adapted to receive a tube in communication with the aperture.

2. The fluid flow sinker according to claim 1, wherein the aperture has a length, $L_A$, wherein a first portion of the aperture has a diameter, $D_{A1}$, wherein a second portion of the aperture has a diameter $D_{A2}$, and wherein $D_{A2}$ is greater than $D_{A1}$.

3. The fluid flow sinker according to claim 2, wherein the first portion of the aperture is adjacent the first end of the body, and wherein the second portion of the aperture is adjacent the second end of the body.

4. The fluid flow sinker according to claim 1, wherein the fluid passageway comprises a plurality of recesses extending from the first end into the body, all of the recesses having a same shape as compared to one another.

5. The fluid flow sinker according to claim 4, wherein, when viewed from the first end, the plurality of recesses are disposed in a starburst pattern.

6. The fluid flow sinker according to claim 1, wherein the first end comprises a plurality of projections extending therefrom, and wherein the fluid passageway comprises a fluid passage area free of projections, as defined within a total area as measured between the first end, the cylindrical sidewall, and a plane formed at a distal surface of the plurality of projections.

7. The fluid flow sinker according to claim 1, wherein the fluid flow sinker has a fluid removal rate as measured according to a fluid removal test of no less than 99%.

8. The fluid flow sinker according to claim 1, wherein the second end of the fluid flow sinker is adapted such that the aperture remains in fluid communication with a fluid disposed in a vessel when a surface of the second end is oriented in a direction coplanar with a portion of a sidewall of the vessel and when a negative pressure is applied within the aperture.

9. The fluid flow sinker according to claim 1, wherein the fluid flow sinker has a maximum diameter, $D_{MAX}$, and a maximum length, $L_{MAX}$, and wherein $L_{MAX}/D_{MAX}$ is no less than 3.0.

10. The fluid flow sinker according to claim 1, wherein the fluid flow sinker comprises an average density, as measured at 39° F., of no less than 1.05 g/cm$^3$.

11. A fluid flow sinker comprising:

a body including:

a first end of the body and a second end of the body, wherein the entirety of the body from the first end to the second end has a cylindrical sidewall;

an aperture extending between the first and second ends of the body; and a fluid passageway disposed on the first end, the fluid passageway in communication with the aperture, wherein the first end is flat and the second end is outwardly rounded, and wherein the fluid flow sinker is adapted to receive a tube in communication with the aperture at the second end.

12. The fluid flow sinker according to claim 11, wherein the fluid passageway comprises a plurality of recesses extending from the first end into the body, and wherein, when viewed from the first end, the plurality of recesses are disposed in a starburst pattern.

13. The fluid flow sinker according to claim 11, wherein the fluid passageway comprises a plurality of recesses extending from the first end into the body, wherein each of the plurality of recesses is disposed at a relative angle, A, with respect to an adjacent recess, and wherein A is equal between each adjacent recess.

14. The fluid flow sinker according to claim 11, the aperture has an average diameter, $D_A$, and wherein $D_A$ is constant along a length of the aperture.

15. The fluid flow sinker according to claim 11, wherein the first end comprises a plurality of projections extending therefrom, and wherein the fluid passageway comprises a fluid passage area free of projections, as defined within a total area as measured between the first end, the cylindrical sidewall, and a plane formed at a distal surface of the plurality of projections.

16. The fluid flow sinker according to claim 11, wherein the fluid flow sinker has a fluid removal rate as measured according to a fluid removal test of no less than 99%.

17. A fluid flow sinker assembly comprising:

a fluid flow sinker including:

a body having a first end of the body and an at least partially outwardly rounded second end of the body, wherein the entirety of the body from the first end to the second end has a cylindrical sidewall, and an aperture extending between the first and second ends of the body; and a fluid passageway disposed on the first end, the fluid passageway in communication with the aperture; and a tube in communication with the aperture at the second end.

18. The fluid flow sinker assembly according to claim 17, wherein the aperture has an average diameter, $D_A$, and a maximum diameter, $D_{MAX}$, and wherein $D_{MAX}/D_A$ is at least 1.1.

19. The fluid flow sinker assembly according to claim 18, wherein the fluid passageway comprises a plurality of recesses extending from the first end into the body, and wherein at least one of the recesses has a rectangular profile.

20. The fluid flow sinker assembly according to claim 17, wherein the fluid flow sinker has a fluid removal rate as measured according to a fluid removal test of no less than 99%.

* * * * *